US010506831B2

(12) United States Patent
Shen et al.

(10) Patent No.: US 10,506,831 B2
(45) Date of Patent: Dec. 17, 2019

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Youli Shen, Shenzhen (CN); Yonghai Li, Shenzhen (CN); Zhongli Xu, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 188 days.

(21) Appl. No.: 15/829,915

(22) Filed: Dec. 2, 2017

(65) Prior Publication Data

US 2018/0153222 A1 Jun. 7, 2018

(30) Foreign Application Priority Data

Dec. 2, 2016 (CN) ..... 2016 1 1109535
Dec. 2, 2016 (CN) ..... 2016 2 1329907 U

(51) Int. Cl.
*A24F 47/00* (2006.01)
*B67D 7/36* (2010.01)
*H05B 3/44* (2006.01)

(52) U.S. Cl.
CPC ..... *A24F 47/008* (2013.01); *B67D 7/36* (2013.01); *H05B 3/44* (2013.01)

(58) Field of Classification Search
CPC ..... A24F 47/008
See application file for complete search history.

(56) References Cited

U.S. PATENT DOCUMENTS

D836,243 S * 12/2018 Liu ..... D27/167
2018/0153222 A1* 6/2018 Shen ..... B67D 7/36

FOREIGN PATENT DOCUMENTS

| | | | |
|---|---|---|---|
| CN | 105 192 892 | A | 12/2015 |
| CN | 105 192 893 | A | 12/2015 |
| CN | 105 962 420 | A | 9/2016 |
| CN | 205 648 912 | U | 10/2016 |
| CN | 106 539 133 | A | 3/2017 |
| CN | 206 284 401 | A | 6/2017 |
| EP | 3 097 804 | A1 | 11/2016 |

* cited by examiner

*Primary Examiner* — James Harvey
(74) *Attorney, Agent, or Firm* — PROI Intellectual Property US

(57) ABSTRACT

An exemplary atomizer includes a housing, a liquid storage chamber, and an atomization assembly. The atomization assembly includes a main body defining a liquid inlet, a liquid absorbing element arranged in the main body. The liquid storage chamber defines a liquid outlet fitting the liquid inlet in an inner sidewall thereof, and a heating element. A blocking element defining a through hole is provided between an inner sidewall of the liquid storage chamber and the main body. One end of the housing is provided with a movable element. The movable element is capable of rotating relative to the housing to cause rotation of the blocking element, thus allowing the liquid inlet and the liquid outlet to be in communication through the through hole or allowing a sidewall of the blocking element to cut off the communication between the liquid inlet and the liquid outlet.

14 Claims, 6 Drawing Sheets

ATOMIZER AND ELECTRONIC CIGARETTE HAVING SAME

CROSS REFERENCE TO RELATED APPLICATIONS

The present application claims priority to Chinese Patent Application CN 201611109535.8 filed on Dec. 2, 2016 and to Chinese Utility Model Application CN 201621329907.3 filed on Dec. 2, 2016.

TECHNICAL FIELD

The present disclosure relates to the field of smoking sets, and particularly, to an atomizer for an electronic cigarette and an electronic cigarette including the same atomizer.

BACKGROUND

As a substitute of traditional cigarettes, electronic cigarette is receiving more and more concerns and becoming more and more popular for it has advantages such as safety, convenience, health effects and environment friendliness in use. Electronic cigarettes available on the market all include an atomizer and a power supply assembly. The atomizer includes an atomization assembly and a liquid storage space configured for storing liquid. An air flow passage is defined in the liquid storage space. The atomization assembly further includes a liquid absorbing element and a heating element. When the heating element is activated, the liquid in the liquid absorbing element is aerosolized to generate an aerosol, which passes through the air flow passage to exit, thereby creating the feeling of tobacco smoking.

In a typical electronic cigarette, the liquid absorbing element and the heating element which are disposed in the atomizer are accommodated in an atomization chamber. The liquid absorbing element penetrates the atomization chamber to keep constant contact with the liquid storage space which is positioned at the peripheral of the atomization chamber. However, with the atomizer of such structure, the liquid absorbing element often has liquid droplets leaked in a vibrating environment after the liquid absorbing element absorbs excessive liquid, and the dripped liquid flows out along the air flow passage, consequently causing negative experiences to consumers.

SUMMARY

In view of the drawbacks in the prior art, the technical problem to be solved by the present disclosure is providing an atomizer and an electronic cigarette which are capable of preventing a liquid absorbing element from keeping constant contact with a liquid storage space to absorb excessive liquid to lead to liquid leakage.

In order to realize the above purpose of the present disclosure, the present disclosure employs an atomizer as follows. The atomizer for an electronic cigarette includes a housing, a liquid storage chamber arranged in the housing, and an atomization assembly arranged in the housing, the atomization assembly including a main body, a liquid absorbing element arranged in the main body, and a heating element arranged in the main body; the main body defines a liquid inlet, and the liquid storage chamber defines a liquid outlet fitting the liquid inlet in an inner sidewall thereof; a blocking element is further provided between an inner sidewall of the liquid storage chamber and the main body, and a through hole is defined on the blocking element; one end of the housing is provided with a movable element, which is capable of rotating relative to the housing to cause rotation of the blocking element, thus allowing the liquid inlet and the liquid outlet to be in communication through the through hole or allowing a sidewall of the blocking element to cut off the communication between the liquid inlet and the liquid outlet.

Further, the movable element is capable of driving the blocking element to rotate within a preset range of angles.

Further, the movable element drives the blocking element to rotate through a friction between the movable element and the blocking element.

Further, one end of the housing defines a liquid refill port configured for refilling liquid to the liquid storage chamber; the movable element is detachably disposed at the liquid refill port in a manner of rotation relative to the housing; the movable element drives the blocking element to rotate through a friction between the movable element and the blocking element; and, after the movable element drives the blocking element to rotate by a preset range of angles, the blocking element is restricted and no longer rotates, but the movable element is capable of continuing rotating so as to be detached from or disposed at the liquid refill port.

Preferably, one of the blocking element and the inner sidewall of the liquid storage chamber has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

Preferably, one of the blocking element and the atomization assembly has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

Preferably, the movable element is connected directly or indirectly on the blocking element through a screw thread; while the movable element is screwed on the blocking element, rotation of the blocking element is caused such that the through hole connects the liquid inlet and the liquid outlet; while the movable element is unscrewed, rotation of the blocking element is caused such that the sidewall of the blocking element cuts off the communication between the liquid inlet and the liquid outlet.

Preferably, one end of the housing defines a liquid refill port configured for refilling liquid to the liquid storage chamber; the movable element is detachably disposed at the liquid refill port in a manner of rotation relative to the housing; and a valve configured for sealing the liquid refill port is provided at the position of the liquid refill port, wherein, the valve is capable of being pushed open by an external liquid refill container, so that a tobacco liquid can be refilled into the liquid storage chamber, and, the valve is capable of recovering from deformation and sealing again the liquid refill port after the external liquid refill container is removed from the liquid refill port.

Preferably, the valve includes an elastic sheet pressed against an outer sidewall of the liquid storage chamber, the elastic sheet being sleeved on the blocking element.

The present disclosure further discloses an electronic cigarette, which includes an atomizer and a power supply, wherein the power supply is configured for supplying power to the atomizer, and the atomizer is the atomizer described in any one of the above atomizers.

Compared with the prior art, the atomizer and the liquid absorbing element of the electronic cigarette in the present disclosure can be set not to keep long contact with the liquid in the liquid storage chamber, consequently it is less likely that the liquid absorbing element absorbs excessive liquid to lead to liquid leakage. Thus, a liquid leakage-proof function is realized.

Other beneficial effects of the present disclosure will be described in further detail in exemplary embodiments below.

DETAILED DESCRIPTION

The to-be-solved technical problem, the technical scheme and the beneficial effects of the disclosure will become more clearly understood from the detailed description of the present disclosure below taken in conjunction with accompanying drawings and embodiments. It should be understood that the exemplary embodiments described below are merely to illustrate, but to limit, the present disclosure.

Exemplary Embodiment 1

Figure 1:
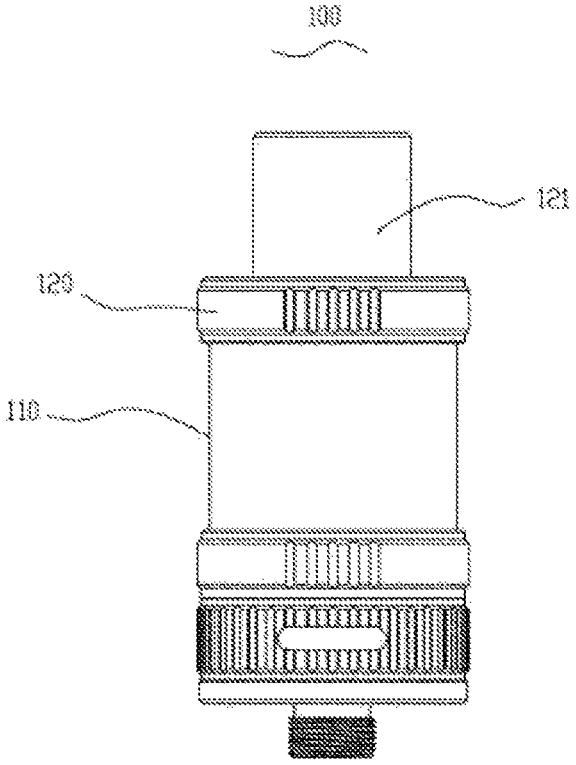
FIG. 1 is a front view of an atomizer.
Figure 2:
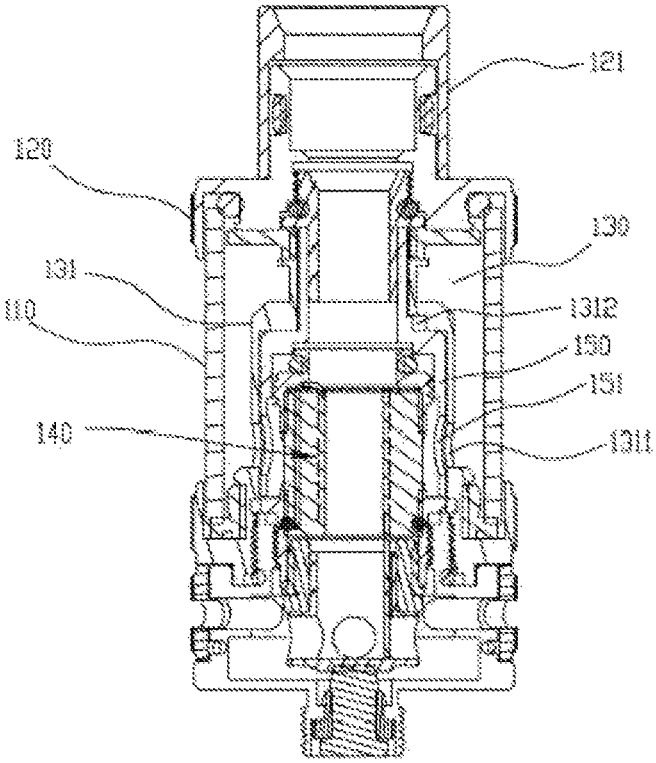
FIG. 2 is a cross-sectional view of the atomizer of FIG. 1.
Figure 8:
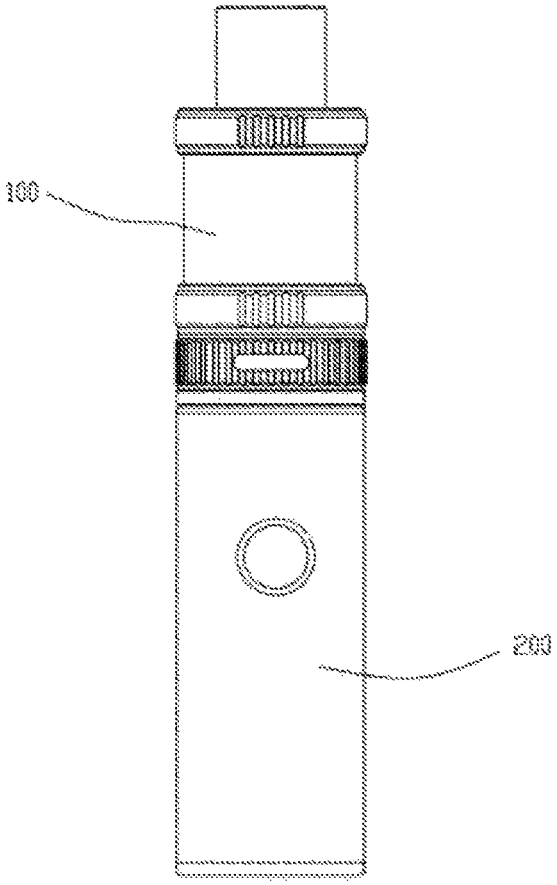
FIG. 8 is a structural main view of an electronic cigarette.

As shown in FIG. 1 and FIG. 2, this embodiment discloses an atomizer 100 for an electronic cigarette, which is coupled with a power supply 200 to form an electronic cigarette (referring to FIG. 8). The atomizer 100 includes a housing 110, and a movable element 120 in detachable connection with one end of the housing 110. A mouthpiece 121 is further detachably connected on the movable element 120.

Figure 3:
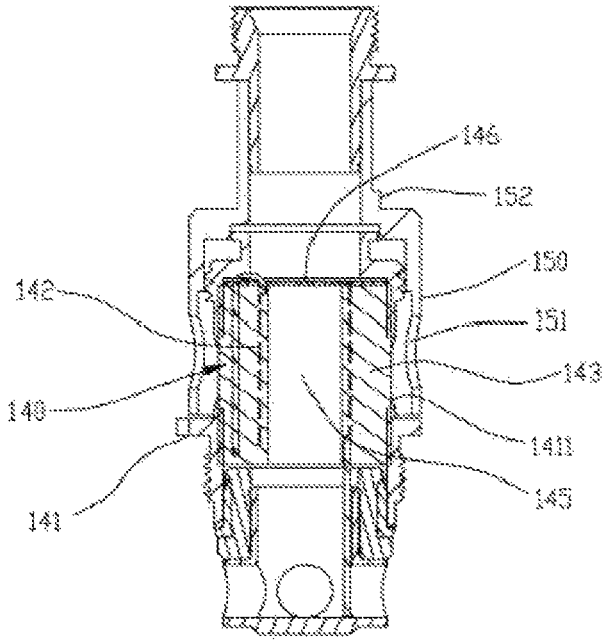
FIG. 3 is a structural cross-sectional view of a blocking element sleeved outside a main body.

As shown in FIG. 2, the housing 110 has provided therein a liquid storage chamber 130 configured for holding liquid and an atomization assembly 140. As shown in FIG. 3, the atomization assembly 140 includes a main body 141, which has a liquid absorbing element 143, a heating element 142 and an air flow passage 145 provided therein. The mouthpiece 121 is in communication with the air flow passage 145. A liquid inlet 1411 is defined in the main body 141, and a liquid outlet 1311 fitting the liquid inlet 1411 is defined in an inner sidewall 131 of the liquid storage chamber 130. A blocking element 150 is further provided between the inner sidewall 131 of the liquid storage chamber 130 and the main body 141, and a through hole 151 is defined on the blocking element 150. The movable element 120 is capable of rotating relative to the housing 110 to cause rotation of the blocking element 150, thus allowing the liquid inlet 1411 and the liquid outlet 1311 to be in communication through the through hole 151 or allowing a sidewall of the blocking element 150 to cut off the communication between the liquid inlet 1411 and the liquid outlet 1311. In this embodiment, the liquid inlet 1411, the liquid outlet 1311 and the through hole 151 are defined to match and fit one another in size and position. The liquid absorbing element 143 is made of cotton material, glass fiber material or ceramic material. The heating element 142 is vertically placed in a manner which is parallel to an axial direction of the atomizer 100. The liquid absorbing element 143 is attached directly on an inner wall of the main body 141 to absorb the liquid influent from each liquid inlet 1411. The atomization assembly 140 aerosolizes the liquid to generate an aerosol, which is expelled from the mouthpiece 121 after passing through the air flow passage 145.

As shown in FIG. 2 and FIG. 3, the blocking element 150 is sleeved on an outer surface of the main body 141. The rotation of the blocking element 150 caused by the movable element 120 is defined in a preset range of angles. It is understandable that the preset range of angles is set only needing to ensure that the liquid inlet 1411 and the liquid outlet 1311 can be in communication with each other or isolated from each other. In this embodiment, the number of the liquid inlet 1411 and the number of the liquid outlet 1311 are set to 4, respectively; the number of the through hole 151 defined on the blocking element 150 is set to 4 too; and the range of rotation of the blocking element 150 is set to 45 degrees.

Figure 4:
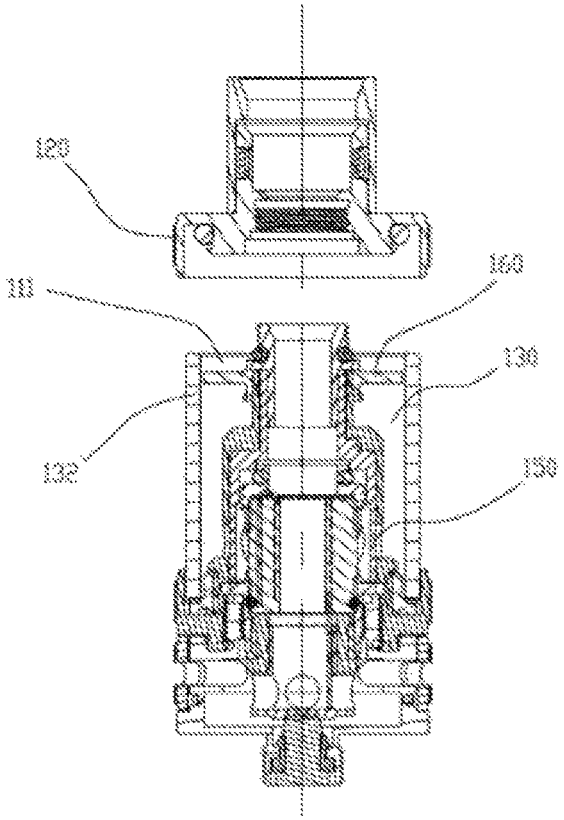
FIG. 4 is a diagram illustrating a state in which a movable element is separated from a housing.
Figure 7:
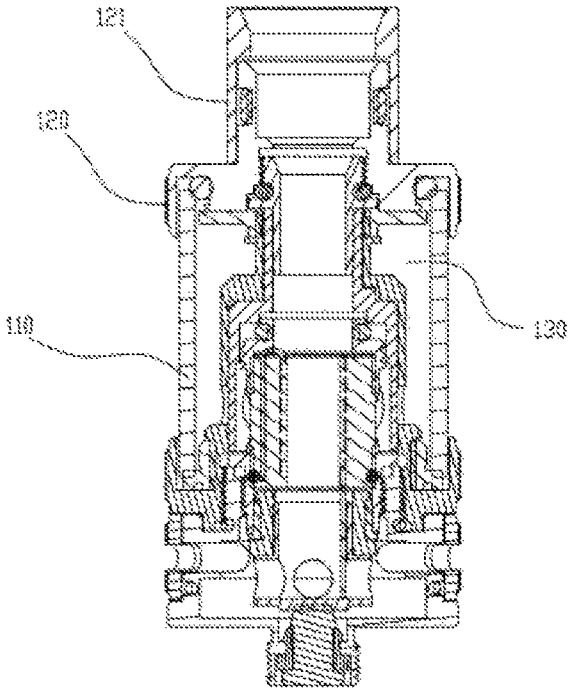
FIG. 7 is a diagram illustrating a state in which a liquid inlet channel is blocked.

In this embodiment, the movable element 120 drives the blocking element 150 to rotate through a friction between the movable element 120 and the blocking element 150. FIG. 2 shows a state in which the through hole 151 connects the liquid inlet 1411 and the liquid outlet 1311 when the movable element 120 is screwed on the housing 110. FIG. 7 shows a state in which rotation of the blocking element 150 is caused in the process of unscrewing the movable element 120, so that a side wall of the blocking element 150 isolates the liquid inlet 1411 from the liquid outlet 1311. FIG. 4 shows a state in which a side wall of the blocking element 150 isolates the liquid inlet 1411 from the liquid outlet 1311 after the movable element 120 is detached.

As shown in FIG. 4, one end of the housing 110 defines a liquid refill port 111 configured for refilling liquid to the liquid storage chamber 130. When the movable element 120 rotates relative to the housing 110, the movable element 120 is adapted for being detachably disposed at the liquid refill port 111. The movable element 120 drives the blocking element 150 to rotate through a friction between the movable element 120 and the blocking element 150. After the movable element 120 drives the blocking element 150 to rotate by a preset range of angles, the blocking element 150 is restricted and no longer rotates, but the movable element 120 is capable of continuing rotating so as to be detached from or disposed at the liquid refill port 111.

Figure 5:
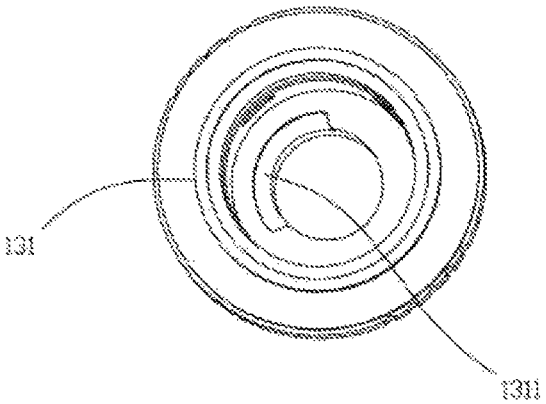
FIG. 5 is a structural perspective view of an inner sidewall of a liquid storage chamber.
Figure 6:
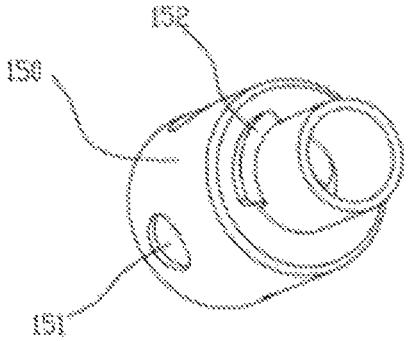
FIG. 6 is a perspective view of a blocking element.

As shown in FIG. 5 and FIG. 6, the blocking element 150 has the setting of the range of rotation implemented by a scheme as below. One of the blocking element 150 and the inner sidewall 131 of the liquid storage chamber 130 has a protrusion 152 thereon while the other defines thereon a guide groove 1311 configured for accommodating the protrusion 152. The protrusion 152 is capable of rotating within a preset range of angles in the guide groove 1311, allowing the through hole 151 to connect the liquid inlet 1411 and the liquid outlet 1311, or allowing the sidewall of the blocking element 150 to cut off the communication between the liquid inlet 1411 and the liquid outlet 1311. In this embodiment, the protrusion 152 is disposed on the blocking element 150, and the guide groove 1311 is correspondingly defined on the inner sidewall 131 of the liquid storage chamber 130.

As shown in FIG. 4, the movable element 120 is connected directly or indirectly on the blocking element 150 through a screw thread. While the movable element 120 is screwed on the blocking element 150, rotation of the blocking element 150 is caused such that the through hole 151 connects the liquid inlet 1411 and the liquid outlet 1311. While the movable element 120 is unscrewed, rotation of the blocking element 150 is caused such that the sidewall of the blocking element 150 cuts off the communication between the liquid inlet 1411 and the liquid outlet 1311. Such arrangement has beneficial effects as follows. When a user screws off the movable element 120 to refill liquid into the liquid refill port 111, it is guaranteed that a liquid inlet channel defined between the liquid inlet 1411 and the liquid outlet 1311 is cut off by the blocking element 150, so that liquid leakage is avoided at the liquid absorbing element 143 during the process of the user refilling the liquid. When the user screws on the movable element 120, rotation of the blocking element 150 is caused such that the through hole 151 connects the liquid inlet 1411 and the liquid outlet 1311 to define a liquid inlet channel.

As shown in FIG. 4, a valve 160 configured for sealing the liquid refill port 111 is provided at the position of the liquid refill port 111. The valve 160 is capable of being pushed open by an external liquid refill container, so that a tobacco liquid can be refilled into the liquid storage chamber 130, and the valve 160 is capable of recovering from deformation and sealing again the liquid refill port 111 after the external liquid refill container is removed from the liquid refill port 111. In this embodiment, the valve 160 is an elastic sheet pressed against an outer sidewall of the liquid storage chamber 130; the elastic sheet is sleeved on the blocking element 150, and is made of rubber or silicone material. The arrangement of the valve 160 makes liquid leakage less likely to occur at the liquid refill port 111.

The above embodiment is just one of the preferred embodiments. Theoretically, in other embodiments, the blocking element 150 also may be restricted in a preset range of angles in a way as below. One of the blocking element 150 and the atomization assembly 140 has a protrusion thereon while the other defines thereon a guide groove capable of accommodating the protrusion. The protrusion is capable of rotating within a preset range of angles in the guide groove, allowing the through hole 151 to connect the liquid inlet 1411 and the liquid outlet 1311, or allowing the sidewall of the blocking element 150 to cut off the communication between the liquid inlet 1411 and the liquid outlet 1311.

In this embodiment, since the liquid absorbing element 143 in the atomizer 100 can be set by a user not to keep long contact with the liquid in the liquid storage chamber 130, it is less likely that the liquid absorbing element 143 absorbs excessive liquid to lead to liquid leakage. Thus, a liquid leakage-proof function is realized. In addition, when a user refills liquid into the liquid refill port 111, the risk of liquid leakage can be reduced at the liquid absorbing element 143.

Exemplary Embodiment 2

As shown in FIG. 8, this embodiment discloses an electronic cigarette, which includes an atomizer 100 and a power supply 200. The atomizer 100 and the power supply 200 are coupled through a detachable threaded connection. The power supply 200 is configured for supplying power to the atomizer 100. The atomizer 100 is an atomizer 100 described in the Exemplary Embodiment 1.

The above content illustrates the principle and implementations of the present disclosure using exemplary embodiments. It is understandable that the above implementation is merely to help understand the present disclosure, and cannot be understood as a restriction to the present disclosure. For the ordinary skill in this field, any minor improvements or equivalent substitutions made to the structure shape or construction of the present disclosure according to the idea of the present disclosure are intended to fall within the scope of protection of the present disclosure.

What is claimed is:

1. An atomizer for an electronic cigarette, comprising a housing, a liquid storage chamber arranged in the housing, and an atomization assembly arranged in the housing, the atomization assembly comprising a main body, a liquid absorbing element arranged in the main body, and a heating element arranged in the main body, the main body defining a liquid inlet, the liquid storage chamber defining a liquid outlet fitting the liquid inlet in an inner sidewall thereof; wherein a blocking element is further provided between the inner sidewall of the liquid storage chamber and the main body, and a through hole is defined on the blocking element; wherein one end of the housing is provided with a movable element, which is capable of rotating relative to the housing to cause rotation of the blocking element, thus allowing the liquid inlet and the liquid outlet to be in communication through the through hole or allowing a sidewall of the blocking element to cut off the communication between the liquid inlet and the liquid outlet.

2. The atomizer according to claim 1, wherein the movable element is capable of driving the blocking element to rotate within a preset range of angles.

3. The atomizer according to claim 1, wherein the movable element drives the blocking element to rotate through a friction between the movable element and the blocking element.

4. The atomizer according to claim 2, wherein the movable element drives the blocking element to rotate through a friction between the movable element and the blocking element.

5. The atomizer according to claim 1, wherein one end of the housing defines a liquid refill port configured for refilling liquid to the liquid storage chamber; the movable element is detachably disposed at the liquid refill port in a manner of rotation relative to the housing; the movable element drives the blocking element to rotate through a friction between the movable element and the blocking element; and, after the movable element drives the blocking element to rotate by a preset range of angles, the blocking element is restricted and no longer rotates, but the movable element is capable of continuing rotating so as to be detached from or disposed at the liquid refill port.

6. The atomizer according to claim 2, wherein one of the blocking element and the inner sidewall of the liquid storage chamber has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

7. The atomizer according to claim 5, wherein one of the blocking element and the inner sidewall of the liquid storage chamber has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

8. The atomizer according to claim 2, wherein one of the blocking element and the atomization assembly has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

9. The atomizer according to claim 5, wherein one of the blocking element and the atomization assembly has a protrusion thereon while the other defines thereon a guide groove capable of accommodating the protrusion; and the protrusion is capable of rotating within a preset range of angles in the guide groove, allowing the through hole to connect the liquid inlet and the liquid outlet, or allowing the sidewall of the blocking element to cut off the communication between the liquid inlet and the liquid outlet.

10. The atomizer according to claim 2, wherein the movable element is connected directly or indirectly on the blocking element through a screw thread; while the movable element is screwed on the blocking element, rotation of the blocking element is caused such that the through hole connects the liquid inlet and the liquid outlet; while the movable element is unscrewed, rotation of the blocking element is caused such that the sidewall of the blocking element cuts off the communication between the liquid inlet and the liquid outlet.

11. The atomizer according to claim 5, wherein the movable element is connected directly or indirectly on the blocking element through a screw thread; while the movable element is screwed on the blocking element, rotation of the blocking element is caused such that the through hole connects the liquid inlet and the liquid outlet; while the movable element is unscrewed, rotation of the blocking element is caused such that the sidewall of the blocking element cuts off the communication between the liquid inlet and the liquid outlet.

12. The atomizer according to claim 1, wherein one end of the housing defines a liquid refill port configured for refilling liquid to the liquid storage chamber; the movable element is detachably disposed at the liquid refill port in a manner of rotation relative to the housing; and a valve configured for sealing the liquid refill port is provided at the position of the liquid refill port, wherein, the valve is capable of being pushed open by an external liquid refill container, so that tobacco liquid can be refilled into the liquid storage chamber, and, the valve is capable of recovering from deformation and sealing the liquid refill port again after the external liquid refill container is removed from the liquid refill port.

13. The atomizer according to claim 12, wherein the valve comprises an elastic sheet pressed against an outer sidewall of the liquid storage chamber, the elastic sheet being sleeved on the blocking element.

14. An electronic cigarette, comprising an atomizer and a power supply, the power supply being configured for supplying power to the atomizer, wherein the atomizer is the atomizer according to claim 1.

* * * * *